United States Patent [19]

Perales

[11] 4,302,194

[45] Nov. 24, 1981

[54] COMBINED AQUATIC SUPPORT AND PROPULSION DEVICE

[76] Inventor: Gavino R. Perales, 1854 Heidleman Rd., Los Angeles, Calif. 90032

[21] Appl. No.: 139,823

[22] Filed: Apr. 14, 1980

[51] Int. Cl.[3] ..... B63H 16/04

[52] U.S. Cl. ..... 440/13; 440/21; 440/101

[58] Field of Search ..... 9/301; 440/21, 98, 101, 440/103, 13

[56] References Cited

U.S. PATENT DOCUMENTS 3,800,734 4/1974 Whang ..... 440/13

FOREIGN PATENT DOCUMENTS 142712 7/1903 Fed. Rep. of Germany ..... 440/13

1036729 8/1958 Fed. Rep. of Germany ..... 440/98

1170642 9/1958 France ..... 440/98

2257488 8/1975 France ..... 9/301

819382 9/1959 United Kingdom ..... 440/21

*Primary Examiner*—Trygve M. Blix

*Assistant Examiner*—John C. Paul

*Attorney, Agent, or Firm*—William C. Babcock

[57] ABSTRACT

A combined propulsion and support device for use by a swimmer when the device is in a first operating position, but with the device being quickly and easily transformed to a second position in which it is more compact and occupies a minimum of space when in storage or being transported. The device has a further operational advantage that the resilient pair of fins that form a part thereof are fully protected from damage when the device is in the second position.

6 Claims, 8 Drawing Figures

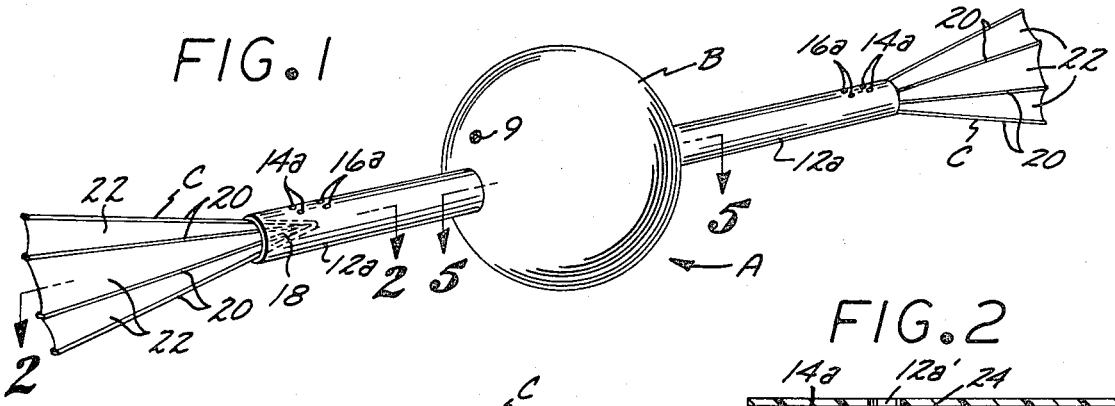
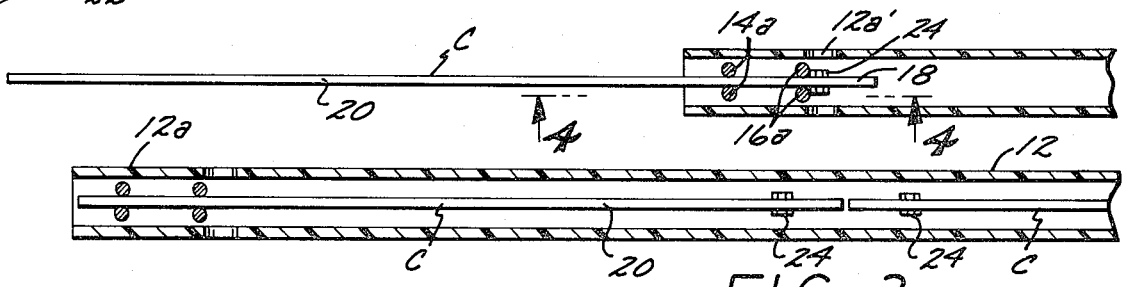
FIG. 3
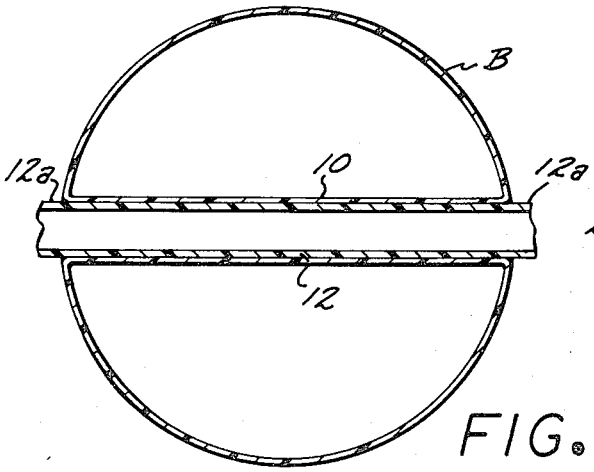
FIG. 5
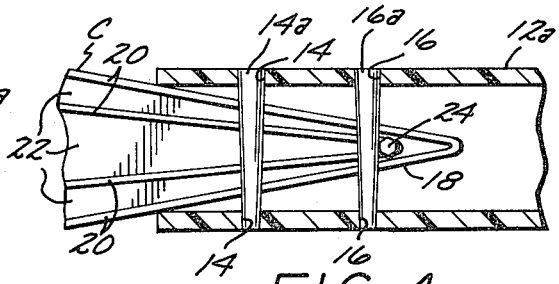
FIG. 4
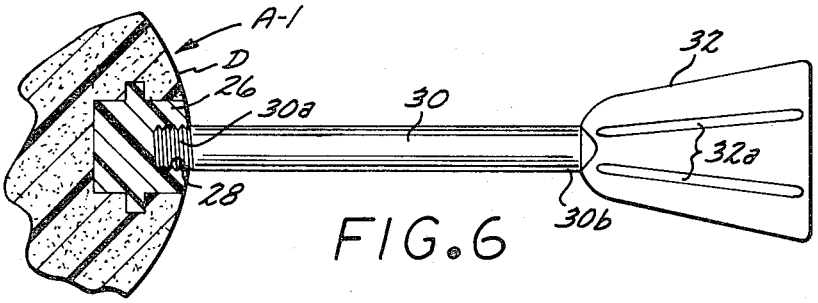
FIG. 6
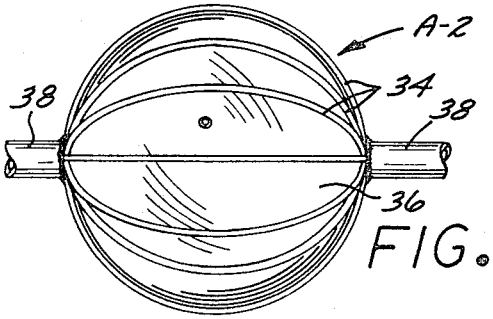
FIG. 7
FIG. 8
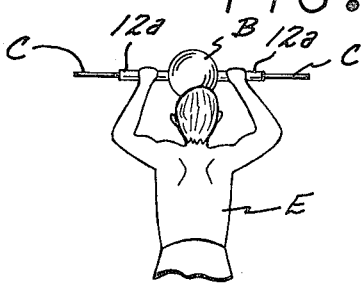

COMBINED AQUATIC SUPPORT AND PROPULSION DEVICE

BACKGROUND OF THE INVENTION

1. Field of the Invention

Combined Aquatic Support and Propulsion Device.

2. Description of the Prior Art

In the past, various devices have been evolved for assisting a swimmer in propelling himself through the water, as well as serving as a support when the swimmer becomes tired or is in some way physically disabled. Such devices have the operational disadvantage that they are of a bulky and cumbersome nature, and due to their size and inconvenience of moving from place to place, have not come into widespread use.

A primary object in devising the present invention is to supply a combined propulsion and support device for a swimmer, that has a simple mechanical structure, may be fabricated from commercially available components, and may be transformed from an operative position to a second position where it is more compact, and is easily transported from place to place, as well as occupying a minimum of space when in storage.

Another object of the invention is to furnish a swimmer's propulsion and support device that has a pair of resilient fins as a part thereof, which fins when the device is in a first position, are substantially disposed within a pair of rigid tubular members, and as a result the fins are protected from possible damage due to coming in contact with a hard object or being subjected to forces that would tend to tear or otherwise impair the usefulness of the fins for their intended purpose.

SUMMARY OF THE INVENTION

In the preferred form of the invention a hollow inflatable float body is provided that has a pair of diametrically aligned tubes projecting outwardly therefrom in opposite directions which tubes slidably support a pair of triangular shaped resilient swim fins that are laterally deformable to the extent that when in first positions the fins are disposed within the pair of tubes and protected from possible damage. The pair of tubes have first means operatively associated therewith to prevent rotation of the pair of fins when the latter are moved outwardly to second operative positions. Stop means are provided on the tubes to prevent inadvertent separation of the pair of fins from the tubes. In an alternate form of the invention a solid buoyant float body is provided that has a pair of elongate members removably secured thereto in axial alignment and the members projecting from the float body in opposite directions. The pairs of members on their outermost ends support a pair of fins or paddles. When the device is not in use, the members may be separated by the float body, and the members stored side-by-side to occupy a minimum of space.

DESCRIPTION OF THE DRAWINGS

FIG. 1 is a perspective view of a preferred form of the invention;

FIG. 2 is a fragmentary longitudinal cross-sectional view of a portion of the preferred form of the invention taken on the line 2—2 of FIG. 1;

FIG. 3 is the same view as shown in FIG. 2, but with the pair of fins having been moved inwardly to first positions where they are completely concealed within the tubes that form a part of the preferred form of the invention;

FIG. 4 is a fragmentary transverse cross-sectional view of a portion of the preferred form of the invention taken on the line 4—4 of FIG. 2;

FIG. 5 is a transverse cross-sectional view of the float body shown in FIG. 1 and taken on the line 5—5 thereof;

FIG. 6 is a combined side elevational and vertical cross-sectional view of one portion of a first alternate form of the invention;

FIG. 7 is a side elevational view of a second alternate form of the invention; and FIG. 8 is a top plan view of a swimmer utilizing the preferred form of the invention as a support, and a means for propelling himself through the water.

DESCRIPTION OF THE PREFERRED EMBODIMENTS

A preferred form A of the invention is shown in FIG. 1 in which a spherical float body B is provided that is defined by pliable, water impervious sheet material and the body including a tubular member 10 that extends diametrically therethrough. The inflatable body B preferably has an air inlet 9 of a conventional nature included as a part thereof.

A tube 12 is provided that is substantially of greater length than the diameter of the buoyant body B. The tube 12 is extended through the tubular member 10 and when so disposed provides a pair of tubes 12*a* that extend outwardly from the buoyant body B.

First and second pairs of diametrically aligned, laterally spaced openings 14 and 16 are formed in the outer end portions of the tubes 10 as may best be seen in FIGS. 1, 2 and 4. A pair of swim fins C are provided as may be seen in FIG. 4, each of which is generally triangular in shape, and each including an apex portion 18 from which angularly disposed ribs extend outwardly, and the ribs 20 having webs 22 extending therebetween. Each of the apex portions 18 has a transverse stop 24 mounted thereon, and extending outwardly therefrom. Each of the stops 24 is of a length greater than the width between first and second pairs of pins 14*a* and 16*a* that are removably mounted in the first and second pairs of openings 14 and 16 as shown in FIG. 2. The first and second pairs of pins 14*a* and 16*a* are tapered, and may be removed from the pair of tubes 12*a*, and after such removal, the fins C may also be slid outwardly from the tubes. The pins 14*a* and 12*a* cooperate with the stop 24 to prevent inadvertent separation of the fins C from the pairs of tubes 12*a*.

When the invention A is not in use, the fins C are slid into the confines of the pair of tubes 12*a* as shown in FIG. 3, and when thus disposed are protected from possible damage. Upon it being desired to utilize the preferred form of the invention A, the fins are manually withdrawn from the pair of tubes 12*a* to occupy second positions as shown in FIG. 2.

With the preferred form of the invention A having the fins disposed in second positions, the invention may be used by a swimmer E having his hands grasped the pair of tubes 12*a*, and as such the swimmer is supported in the water. When the swimmer E desires to propel himself through the water, he causes the pair of tubes 12*a* to rotate in opposite directions when they are angularly disposed, with the uppermost one of the fins being disposed above the water as it moves forwardly and the lowermost of the fins being immersed and moving rearwardly. The rearward movement of the lowermost fins causes the swimmer E to be propelled forwardly.

A second alternate form A-1 of the invention is shown in FIG. 6 in which it will be seen that a solid float D formed from a buoyant material such as styrofoam is provided that has a pair of connectors of a solid material supported from opposite sides thereof in diametrical alignment. Each of the connectors has a tapped recess 28 therein, which recess is engaged by a first threaded end 30*a* of an elongate member 30, and the second end 30*b* of the member supporting a fin or paddle 32. The fin 32 preferably has reinforcing members 32*a* formed as a part thereof. When it is desired to transport or store the alternate form A-1 of the invention the members 30 are unscrewed from the connectors 26 and the members together with the paddles 32 may be stored side-by-side to occupy a minimum of space. The first alternate form A-1 of the invention is used in the same manner as the alternate from A thereof.

A second alternate form A-2 of the invention is illustrated in FIG. 7 and includes a generally spherical resilient wire cage 34 that has an internal diameter slightly less than that of a conventional basketball 36. The basketball is inserted into the confines of the cage 34 when the basketball is not inflated, and as the basketball is inflated by use of an air inlet 36 it expands and comes into pressure contact with the interior surface of the cage 34. The cage 34 has a pair of elongate members rigidly secured thereto in diametrical alignment, and with the members extending outwardly therefrom in opposite directions. The members 38 may be tubular and the construction of the invention as shown in FIG. 1 embodied as a part thereof. Also, the elongate members 38 may be solid, and serve the same function as the members 30 in the form of the invention A-1 illustrated in FIG. 6. When the form of the invention A-2 is utilized, the combined propulsion and support device for a swimmer is operated in the same manner as the preferred form A of the invention and provides the same result. After the second alternate form of the invention A-2 has been used, the basketball 36 may be deflated and removed from the cage 34. The wire of the cage 34 is resilient, and the two members may deform the cage to be disposed either angularly to one another or disposed substantially side-by-side.

The use and operation of the invention has been explained previously in detail and need not again be repeated.

What is claimed is:

1. A swimmer's combined propulsion and support device which may be disposed to occupy a minimum of space when not in use and that includes:

a. a buoyant body;

b. a pair of rigid axially aligned tubes that extend outwardly from said body;

c. a pair of resilient triangular shaped fins that include apex portions, with one of said apex portions at all times slidably mounted in one of said tubes, and each of said tubes of sufficient length as to have said fin associated therewith slid into the interior thereof to a first position when said device is to be stored, and each of said fins capable of being manually moved outwardly in said tube with which it is associated to a second position to have the major portion of said fin project therefrom;

d. first means for preventing said pair of fins rotating relative to said pair of tubes when said pair of fins are in said second positions; and e. second means for preventing said pair of fins inadvertently separating from said pair of tubes, and said device occupying a minimum of storage space when said pair of fins are in said first position.

2. A device as defined in claim 1 in which said first means are a plurality of laterally spaced pins that occupy diametrically extending positions in the outer portions of said pair of tubes, and said plurality of pairs of pins having said pair of fins disposed therebetween.

3. A device as defined in claim 2 in which said second means are transversely disposed stops mounted on said apex portions of said fins, said stops being of a length greater than the width between said pairs of pins, and said stops contacting said pins when said fins are in said second position to prevent further outward movement of said pair of fins relative to said pair of tubes.

4. A device as defined in claim 3 in which said pairs of pins are removably mounted in said pair of tubes, with said pairs of pins when removed from said tubes allowing said pair of fins to be withdrawn from said pair of tubes.

5. A device as defined in claim 1 in which said body is a hollow inflatable sphere defined by a water impervious sheet material that has an opening extending diametrically therethrough, and a tube of substantially greater length than that of said opening, and that extends through the latter to define said pair of tubes on opposite sides of said body.

6. A device as defined in claim 1 in which said body includes:

f. a resilient wire cage of generally spherical form that has said pair of tubes secured thereto and extending outwardly therefrom, wth the interior of said cage slightly less than that of an inflated basketball; and g. an inflated basketball disposed in said cage that pressure contacts said cage and imparts rigidity thereto.

* * * * *